US005957780A

United States Patent [19]

Grazioli

[11] Patent Number: 5,957,780

[45] Date of Patent: Sep. 28, 1999

[54] CONVERTIBLE BED-TYPE SWING

[75] Inventor: Vittorio Grazioli, Asola, Italy

[73] Assignee: Grazioli S.p.A., Canneto S/Oglio, Italy

[21] Appl. No.: 09/073,805

[22] Filed: May 6, 1998

[30] Foreign Application Priority Data

May 8, 1997 [IT] Italy ..... BS97U0046

[51] Int. Cl.[6] ..... A63G 9/00

[52] U.S. Cl. ..... 472/118; 472/125; 297/354.13; 5/126

[58] Field of Search ..... 472/118, 119, 472/120, 125; 297/354.13; 403/348, 294, 400, 395; 5/37.1, 124, 125, 126

[56] References Cited

U.S. PATENT DOCUMENTS

| | | | |
|---|---|---|---|
| 427,900 | 5/1890 | Pearson | 5/37.1 |
| 1,406,737 | 2/1922 | Hoy | 5/126 |
| 1,511,806 | 10/1924 | Englander | 297/354.13 |
| 1,973,229 | 9/1934 | Smith | 5/126 |
| 2,506,640 | 5/1950 | Hawes | 403/400 |
| 5,564,987 | 10/1996 | Ayrolles | 472/118 |
| 5,803,818 | 9/1998 | Tseng | 472/118 |

*Primary Examiner*—Kien T. Nguyen
*Attorney, Agent, or Firm*—McGlew and Tuttle, P.C.

[57] ABSTRACT

The convertible bed-type swing includes a stationary frame and an oscillating frame rotatably connected to the stationary frame. The oscillating frame includes a seat and seat back with a strut rotatably connected to the seat. The seat back has a bolt mounted on the strut for locking and unlocking the strut to and from the oscillating frame. The strut is positioned on an end side of the seat back and extends from the seat to a side of the seat back diametrically opposite the seat.

14 Claims, 5 Drawing Sheets

CONVERTIBLE BED-TYPE SWING

FIELD OF THE INVENTION

The subject of the present invention is a convertible bed-type swing.

BACKGROUND OF THE INVENTION

Swings, in which the part forming the seat back is capable of moving from a vertical position to a horizontal position, are already known. However, it is not possible to achieve a true horizontal position in the prior-art swings and thus not a truly "bed-type" position. In addition, in the prior-art solutions, there is the problem of completely locking the swing, which currently is solved by means of rather complex and especially impractical devices and methods.

SUMMARY AND OBJECTS OF THE INVENTION

The object of the present invention is to eliminate the aforementioned problems by means of adopting simple devices that make the use of the swing more convenient and efficient.

The convertible bed-type swing includes a stationary frame and an oscillating frame rotatably connected to the stationary frame. The oscillating frame includes a seat and seat back with a strut rotatably connected to the seat. The seat back has a bolt means mounted on the strut for locking and unlocking the strut to and from the oscillating frame. The strut is positioned on an end side of the seat back and extends from the seat to a side of the seat back diametrically opposite the seat. The bolt means includes an L-shaped portion defining a slit. The bolt means also includes a slider positioned, and slidable, in the slit. The slider defines a cut with substantially circular ends and a substantially straight central section, a width of the central section is less than a diameter of the ends. The slider and the L-shaped portion form a C bolt for fixing the strut to the oscillating frame. A shank with a key means is included in the bolt means for locking and unlocking of the slider by rotation of the shank. The bolt means further includes a C-shaped portion arranged in a plane that is substantially perpendicular with a plane of the L-shaped portion. The C-shaped portion forms a means for attaching to the stationary frame by pressure, especially to a tie rod in a rear part of the stationary frame.

In one embodiment the bolt means includes first and second parts fixed around the strut of the seat back. The first part defines a slit, and the bolt means includes a slider positioned, and slidable, in the slit. The slider then defines a passing cut. The first part of the bolt means defines an opening, and the bolt means includes a disk-shaped element positioned in the opening. The disk-shaped element includes a pawl interacting as a key means with the passing cut, and moves the slider between positions selectively locking and unlocking the seat back from the strut upon rotation of the diskshaped element.

A hinge means connects the seat to the seat back for exact complanation or planar joining of the seat and seat back. The hinge is arranged at a lower level than the plane formed by the seat and the seat back in exact complanation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
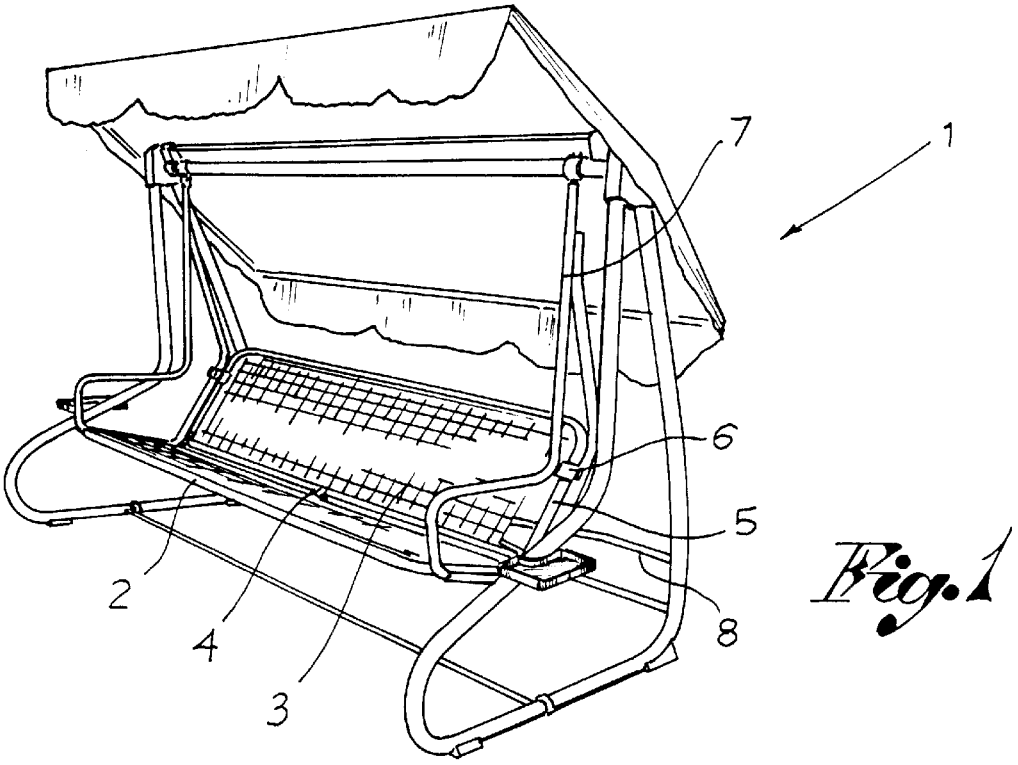
FIG. 1 is a view of a swing having an essentially known shape in its entirety.

Referring to the drawings, and in particular to FIG. 1, a swing is shown in its entirety by 1, with the swing having a seat 2 and a seat back 3, which are suitably hinged at 4. Bolts, which are globally indicated by 6, are suitably inserted on the vertical rods or struts 5 of the seat back 3.

Figure 6:
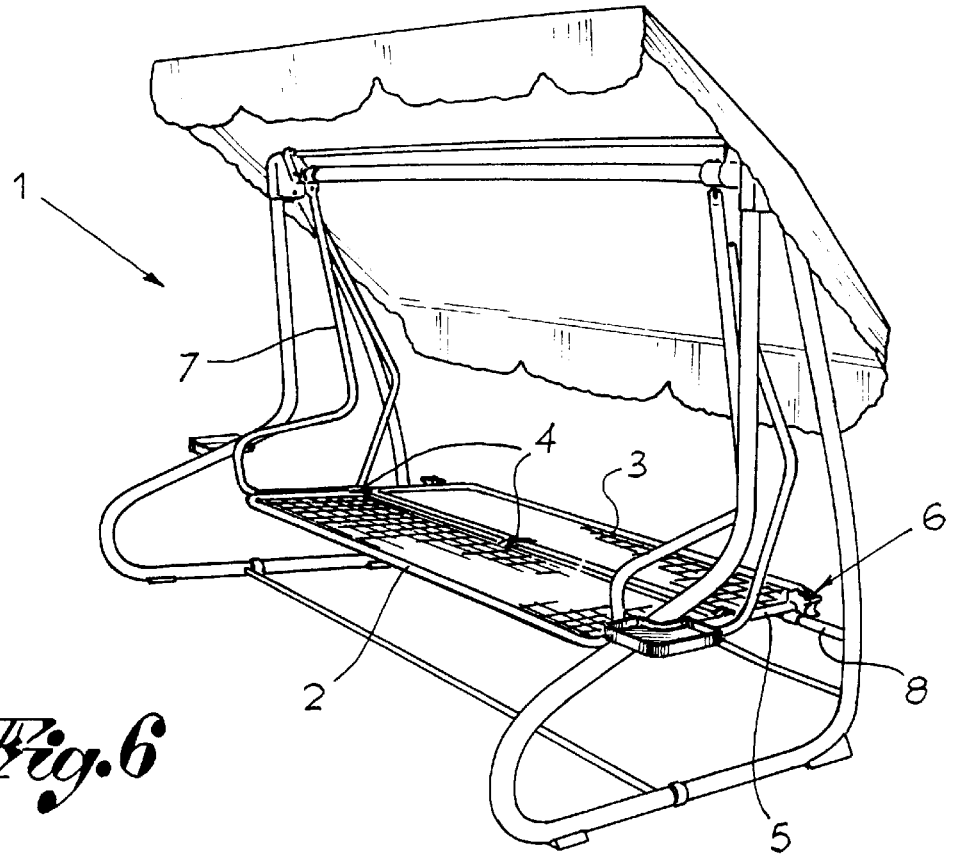
FIG. 6 is a view of the swing in the bed position.
Figure 3:
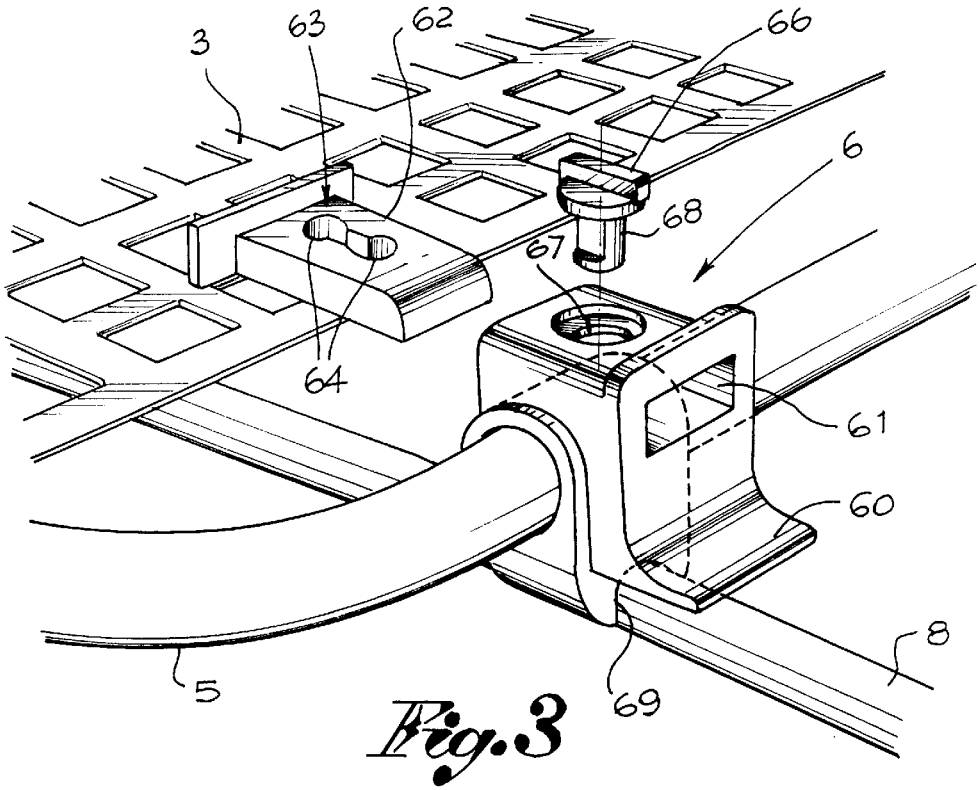
FIG. 3 is an exploded view of the bolt according to FIG. 2.
Figure 2:
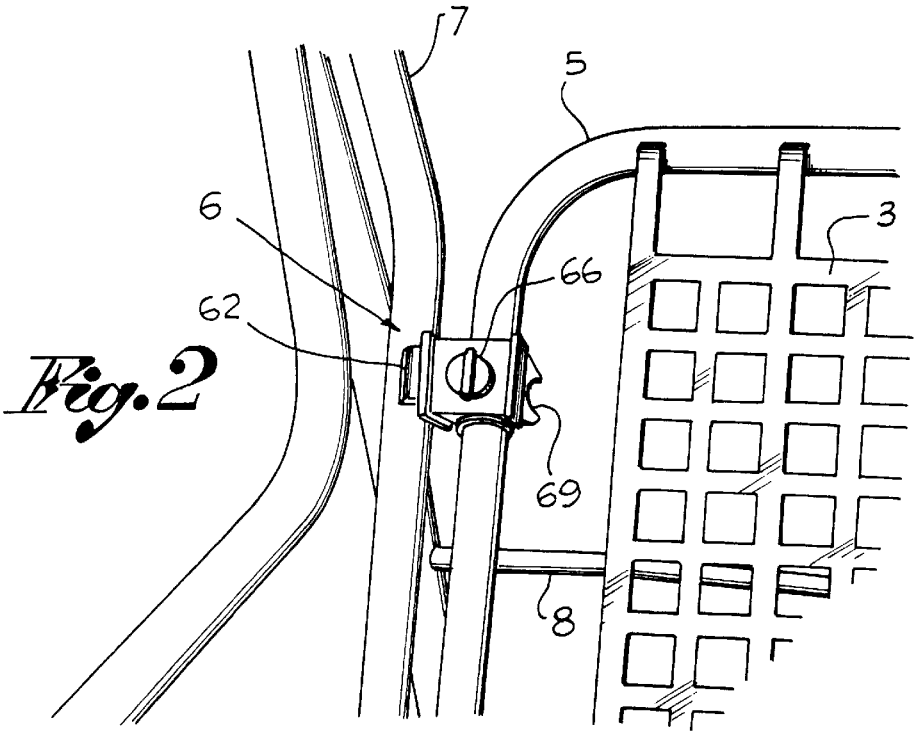
FIG. 2 is a view of the locking bolt of the seat back of the swing in detail.

The bolts 6 consist of blocks made of suitable material and they have a plurality of functions. One function is to support the seat back 3, when in the vertical position, in a fixed and integral manner with the oscillating frame 7 of the swing, Another function is to support the seat back 3 in the horizontal position (see FIG. 6), fixed in a locked position to the tie rod 8 present in a rear part of a stationary frame of the swing (see FIG. 3).

In greater detail, the bolt 6 has an essentially L-shaped portion 60, on the surface of which is additionally provided a slit 61 for passing a slider 62, and the slider has a cut 63 whose ends 64 have a circular cross section, while the central part 65, having a rectangular cross section, has a size that is less than the diameter of the ends 64. The slider 62 to be inserted in the slit 61 is to define, in combination with the portion 60, a C bolt, which is intended to enclose the oscillating frame 7, and in this manner fix the seat back 3 to the oscillating frame 7 proper.

Figure 5:
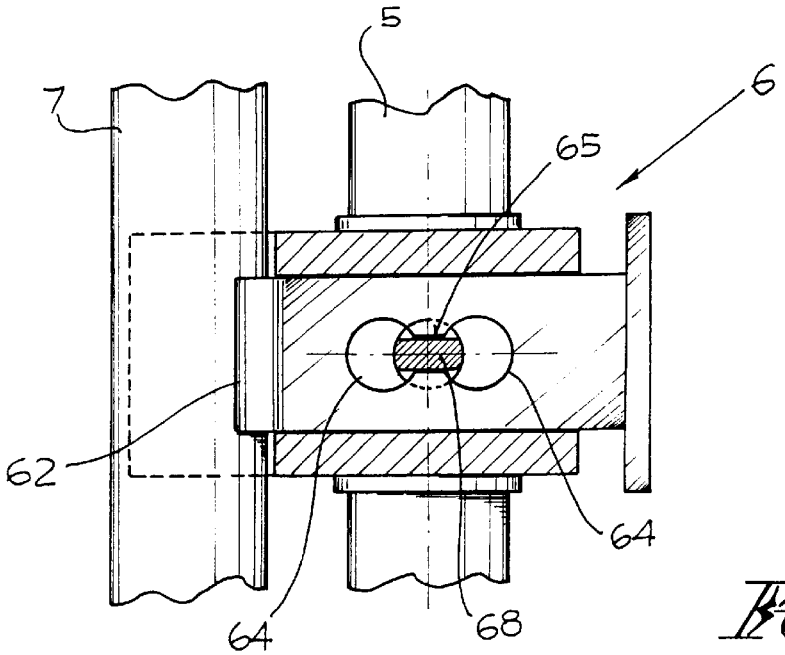
FIG. 5 is another view of the locking bolt in partial top section with the seat back in the unlocked position.
Figure 4:
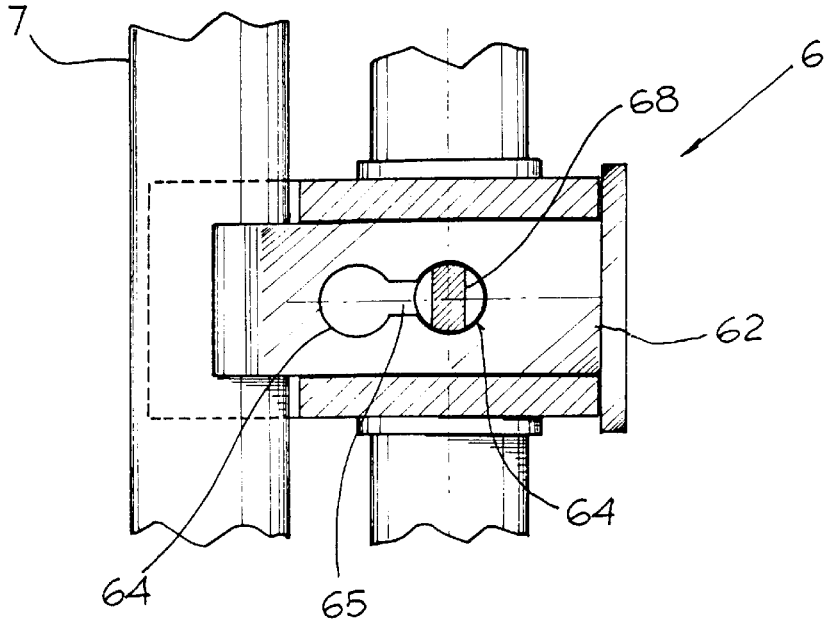
FIG. 4 is a partial top section of the same bolt with the seat back in the locked position.

A key 66 is provided for this purpose. This key 66 is inserted into a hole 67 arranged on the upper face of the bolt or, provided with a shank 68. The shank has a rectangular cross section of such a size so as to pass through section 65 of the cut 63, making possible, in this position, the movement of the slider 62 (see FIG. 5). In the same manner, when the key 66, and consequently the shank 68, is in the situation according to FIG. 4 and in a position which is rotated 90° from FIG. 5, the slider 62 is prevented from moving.

The possibility of, respectively, unlocking the frame 5 of the seat back 3 from the oscillating frame 7 of the swing to put it in the bed-type position, or of supporting the swing in the normal sitting position is the result of the two different use situations.

The bolt 6 additionally has a C-shaped lower portion 69, in which the C-shape is arranged in a plane that is perpendicular with respect to a plane defined by the portion 60 in combination with the slider 62. The portion 69 (see FIG. 3) is intended to be fixed, by means of pressure, on the tie rod 8 present in the rear part of the swing in order to keep the seat-seat back unit firmly fixed when in the bed-type position.

Figure 7:
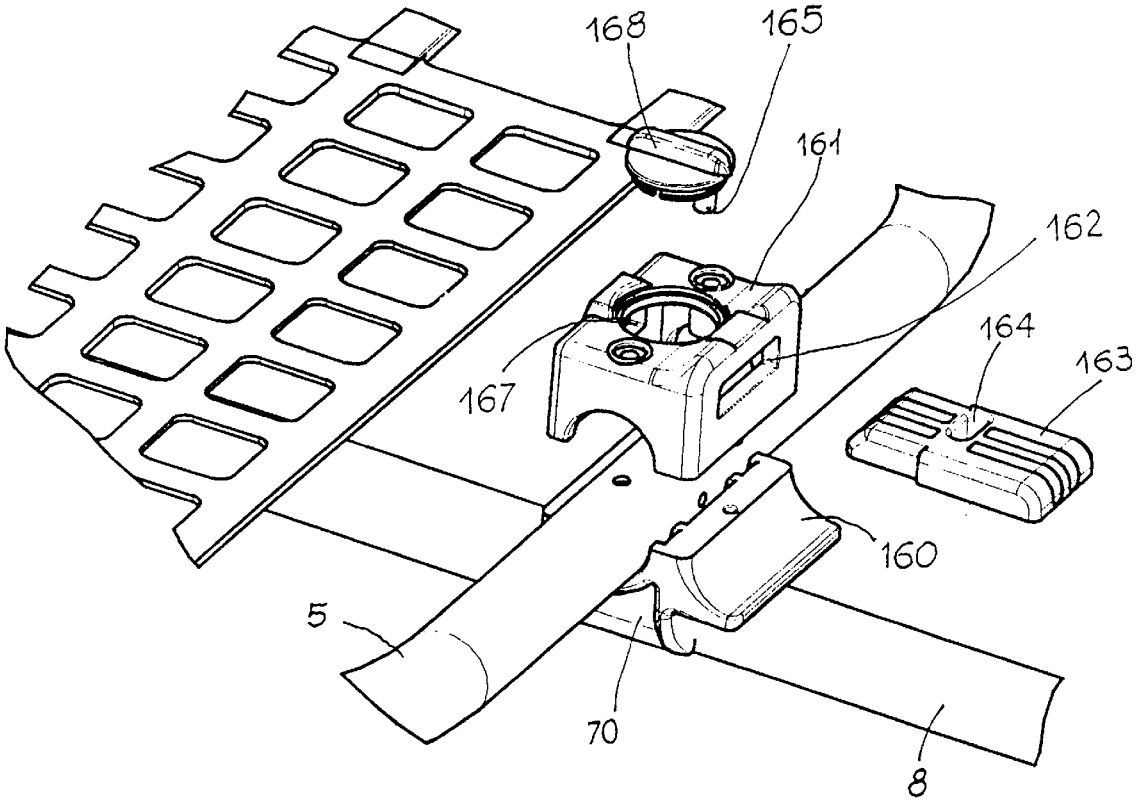
FIG. 7 is an exploded view of a structural and functional variant of the bolt according to FIG. 2.
Figure 8:
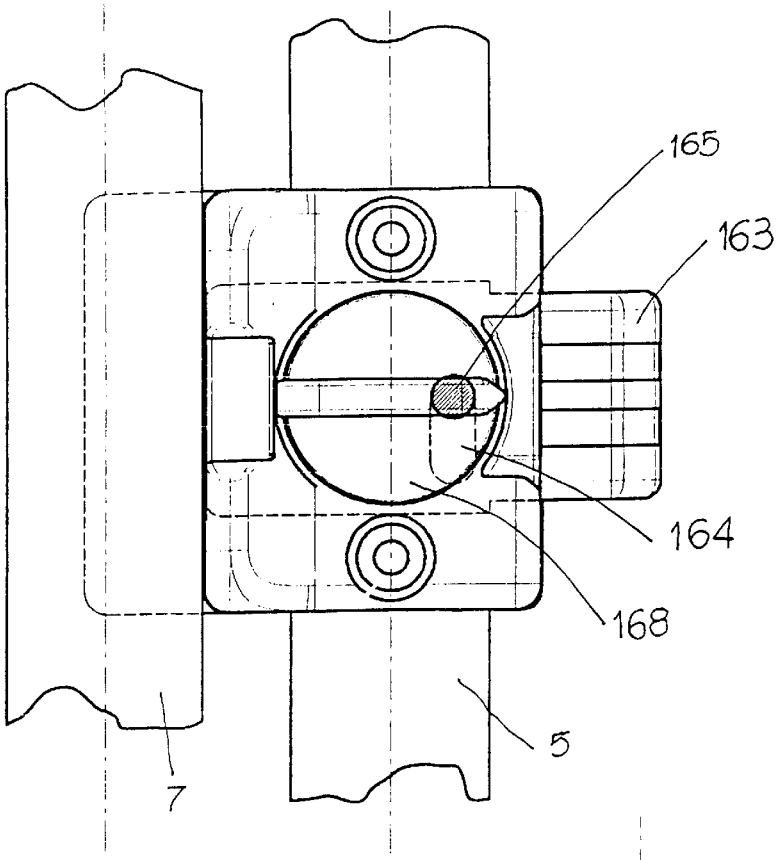
FIGS. 8 and 9 are sectional views of the variant.
Figure 9:
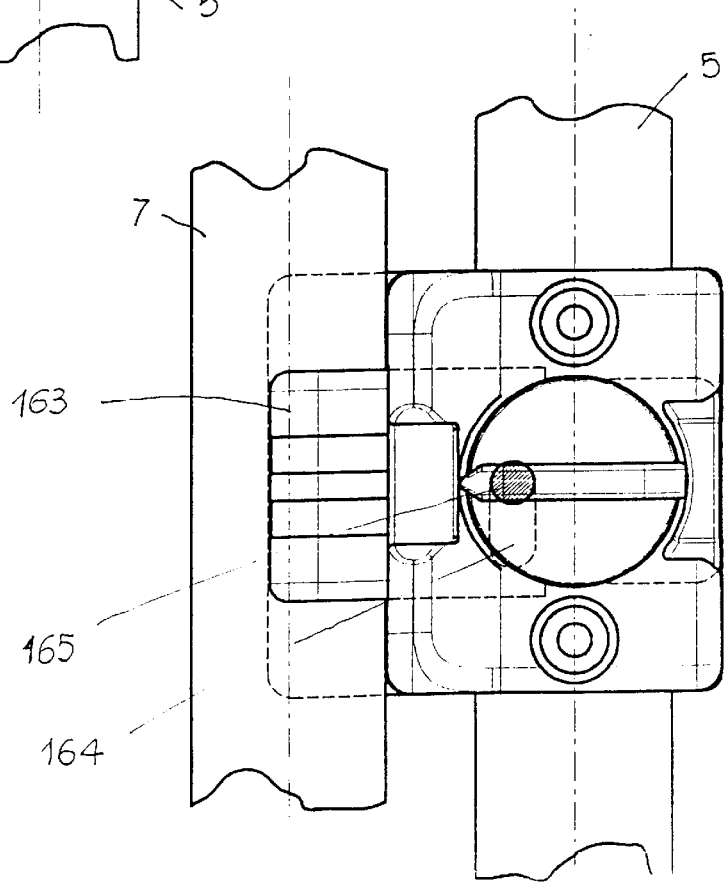

According to the structural variant or embodiment of FIGS. 7, 8 and 9, the bolt may analogously consist of a C-shaped part 70 arranged on a plane that is perpendicular compared with that of the portion 160, which is intended to be fixed by means of pressure on the tie rod 8.

A block 161 is provided with a slit 162, in which a slider 163 provided with a passing cut 164 is to be inserted. The block 161 is suitably connected to the part 70 in order to support and to be fixed to the frame 5 of the seat back 3. The block 161 additionally has a circular opening 167, which is intended to receive a complementary disk-shaped element 168 which is provided in its lower part with a pawl 165, which is intended to interact, as a key, with the passing cut 164.

The rotating action on the disk-shaped element 168 permits the dragging of the slider 163 selectively from a position of release from the frame 5 (see FIG. 8) to a position of fixing with the frame (see FIG. 9) by means of the movement of the pawl inside the cut 164.

Finally, it should be noted that the connecting hinge 4, which is arranged between the seat back 3 and the seat 2, has a shape so as to remain at a lower level compared with the plane defined by the respective frames forming the seat and the seat back and to make possible the perfect complanation or level joining between the seat and seat back.

As described above, it is possible to see that the swing under examination has a novel and different arrangement of parts, such as to make its use and the passage from the sitting position to the bed-type position easier, simpler, and more efficient.

While specific embodiments of the invention have been shown and described in detail to illustrate the application of the principles of the invention, it will be understood that the invention may be embodied otherwise without departing from such principles.

What is claimed is:

1. A convertible bed-type swing comprising:

a stationary frame;

an oscillating frame rotatably connected to said stationary frame, said oscillating frame including a seat and seat back rotatably connected to said seat, said seat back including a strut;

a bolt mechanism mounted on said strut for locking and unlocking said strut to and from said oscillating frame, said bolt mechanism including an L-shaped portion defining a slit, and a slider positioned, and slidable, in said slit.

2. A swing in accordance with claim 1, wherein:

said slider defines a cut with substantially circular ends and a substantially straight central section, a width of said central section being less than a diameter of said ends.

3. A swing in accordance with claim 2, wherein:

said bolt means includes a key including a shank having mechanism for locking and unlocking of the slider by rotation of said shank.

4. A swing in accordance with claim 1, wherein:

said slider and said L-shaped portion form a C bolt for fixing said strut to said oscillating frame.

5. A swing in accordance with claim 1, wherein:

said bolt mechanism includes a C-shaped portion arranged in a plane that is substantially perpendicular with a plane of said L-shaped portion, said C-shaped portion including means for attaching to said stationary frame.

6. A swing in accordance with claim 5, wherein:

said means of said C-shape portion attaching by pressure to a tie rod in a rear part of said stationary frame.

7. A swing in accordance with claim 1, further comprising: a hinge connecting said seat to said seat back for exact complanation of said seat and seat back.

8. A swing in accordance with claim 7, wherein:

said hinge is arranged at a level lower than a plane formed by said seat and said seat back in exact complanation.

9. A swing in accordance with claim 1, wherein:

said strut is positioned on an end side of said seat back and extending from said seat to a side of said seat back diametrically opposite said seat.

10. A convertible bed-type swing comprising:

a stationary frame;

an oscillating frame rotatably connected to said stationary frame, said oscillating frame including a seat and seat back rotatable connected to said seat, said seat back including a strut;

a bolt mechanism mounted on said strut for locking and unlocking said strut to and from said oscillating frame, said bolt mechanism including first and second parts fixed around said strut of said seat back, said first part defining a slit, said bolt mechanism including a slider positioned, and slidable in said slit, said slider defining a passing cut.

11. A swing in accordance with claim 10, wherein:

said first part of said bolt mechanism defines an opening, said bolt mechanism including a disk-shaped element positioned in said opening, said disk-shaped element includes a pawl interacting as a key with said passing cut, and for moving said slider between positions of selectively locking and unlocking said seat back from said strut upon rotation of said disk-shaped element.

12. A swing in accordance with claim 10, further comprising: a hinge connecting said seat to said seat back for exact complanation of said seat and seat back.

13. A swing in accordance with claim 12, wherein: said hinge is arranged at a level lower than a plane formed by said seat and said seat back in exact complanation.

14. A swing in accordance with claim 12, wherein: said strut is positioned on an end side of said seat back and extending from said seat to a side of said seat back diametrically opposite said seat.

* * * * *